US007703469B2

(12) United States Patent
Danziger

(10) Patent No.: US 7,703,469 B2
(45) Date of Patent: Apr. 27, 2010

(54) PORTABLE ADJUSTABLE SHADE STRUCTURE

(75) Inventor: Warren L. Danziger, St. Louis, MO (US)

(73) Assignee: PAXDANZ, LLC, St. Louis, MO (US)

( * ) Notice: Subject to any disclaimer, the term of this patent is extended or adjusted under 35 U.S.C. 154(b) by 6 days.

(21) Appl. No.: 12/157,756

(22) Filed: Jun. 13, 2008

(65) Prior Publication Data

US 2009/0308424 A1 Dec. 17, 2009

(51) Int. Cl.
*E04H 15/48* (2006.01)
*E04H 15/46* (2006.01)
*E04H 15/52* (2006.01)

(52) U.S. Cl. ..... 135/147; 135/139; 135/120.3; 135/157

(58) Field of Classification Search ..... 135/87, 135/98, 120.2, 120.3, 121, 122, 123, 135, 135/139, 140, 141, 142, 143, 144, 146, 147, 135/151, 157, 158, 159, 160; 403/64, 171, 403/176

See application file for complete search history.

(56) References Cited

U.S. PATENT DOCUMENTS

| | | | | |
|---|---|---|---|---|
| 684,130 | A | 10/1901 | Taubert | |
| 1,326,006 | A | 12/1919 | Sterhardt | |
| 1,493,915 | A | 5/1924 | Baker | |
| 1,502,898 | A * | 7/1924 | Berg | 135/98 |
| 1,666,757 | A * | 4/1928 | Snyder | 135/146 |
| 1,712,836 | A | 5/1929 | Mills | |
| 1,728,356 | A | 9/1929 | Morgan | |
| 1,820,002 | A * | 8/1931 | Forrester | 135/140 |
| 1,846,496 | A * | 2/1932 | Mills | 135/98 |
| 1,853,367 | A | 4/1932 | Mace | |
| 2,111,578 | A | 3/1938 | Weaver | |
| 2,137,625 | A * | 11/1938 | Norvell | 135/147 |
| 2,232,306 | A * | 2/1941 | Baldwin | 135/139 |
| 2,764,993 | A | 10/1956 | Wallace et al. | |
| 3,181,542 | A * | 5/1965 | Bareis | 135/98 |
| 3,199,518 | A | 8/1965 | Glidewell | |
| 3,375,624 | A | 4/1968 | Mikulun | |
| 3,496,687 | A | 2/1970 | Greenberg et al. | |
| 4,006,768 | A | 2/1977 | Horgan, Jr. | |
| 4,074,682 | A * | 2/1978 | Yoon | 135/135 |
| 4,156,433 | A | 5/1979 | Beaulieu | |
| RE31,565 | E | 4/1984 | Beaulieu | |
| 4,607,656 | A | 8/1986 | Carter | |
| 4,641,676 | A | 2/1987 | Lynch | |
| 4,779,635 | A | 10/1988 | Lynch | |

(Continued)

OTHER PUBLICATIONS

Written Opinion and International Search Report from co-pending patent Application No. PCT/US2009/003478.

*Primary Examiner*—David Dunn
*Assistant Examiner*—Danielle Jackson
(74) *Attorney, Agent, or Firm*—Gallop, Johnson & Neuman, L.C.

(57) ABSTRACT

The present invention is a canopy structure comprising a frame and a canopy. The frame comprises a plurality of arms and legs, where each of the arms extends outwardly from a central connecting member to a leg, each arm and leg being joined by a leg connecting member. Preferably, each leg is telescopic and is lockable and the central connecting member preferably comprises a releasable locking mechanism. The present invention further comprises a mechanism by which the canopy surface can be tilted to angles relative to the ground.

1 Claim, 16 Drawing Sheets

U.S. PATENT DOCUMENTS 4,835,918 A 6/1989 Dippel
4,924,896 A 5/1990 Carter
5,000,211 A 3/1991 Speare et al.
5,020,559 A 6/1991 Lai
5,035,253 A 7/1991 Bortles
RE33,710 E 10/1991 Zeigler
5,121,765 A 6/1992 MacMorris, Jr.
5,213,123 A 5/1993 Whitfield
5,234,011 A 8/1993 Lynch
5,339,847 A 8/1994 Kanter et al.
5,390,685 A 2/1995 McCoy
5,421,356 A 6/1995 Lynch
D365,884 S 1/1996 Dennis
5,485,863 A 1/1996 Carter
5,488,966 A 2/1996 Baldwin et al.
5,490,533 A 2/1996 Carter
5,511,572 A 4/1996 Carter
D377,822 S 2/1997 Lichia
5,611,364 A 3/1997 Woods et al.
5,632,292 A 5/1997 Carter
5,632,293 A 5/1997 Carter
5,752,537 A 5/1998 Kranzler
5,802,778 A 9/1998 Thorp et al.
D403,782 S 1/1999 James
5,884,646 A * 3/1999 Ju ..... 135/135
5,921,260 A 7/1999 Carter
5,930,971 A * 8/1999 Etheridge ..... 52/646
5,934,301 A 8/1999 Carter
D418,611 S 1/2000 Montague, III
6,035,874 A 3/2000 Po-Chang
6,035,877 A 3/2000 Losi, Jr. et al.
6,041,800 A 3/2000 Carter
6,058,952 A 5/2000 Lin et al.
6,076,312 A 6/2000 Carter
6,089,245 A 7/2000 Tseytlin et al.
6,129,102 A 10/2000 Carter
6,138,702 A 10/2000 Carter
6,173,726 B1 1/2001 Talmadge
6,192,910 B1 2/2001 Carter
6,216,717 B1 * 4/2001 Chen ..... 135/130
6,230,729 B1 5/2001 Carter
6,240,940 B1 6/2001 Carter
D445,916 S 7/2001 Pritchard
6,302,124 B1 10/2001 Demarco
6,302,125 B1 10/2001 Lin et al.
6,357,461 B1 3/2002 Chai et al.
6,363,956 B2 4/2002 Carter
6,374,842 B1 4/2002 Carter
6,382,224 B1 5/2002 Carter
6,397,872 B1 6/2002 Carter
6,431,193 B2 8/2002 Carter
6,439,251 B2 8/2002 Carter
6,470,902 B1 10/2002 Carter
6,561,257 B2 5/2003 Huang
6,591,849 B1 * 7/2003 Swetish et al. ..... 135/140
6,701,949 B2 3/2004 Carter
6,708,707 B2 3/2004 Dotterweich et al.
6,712,083 B2 3/2004 Carter
6,742,309 B2 6/2004 Brillhart, III et al.
6,748,963 B2 6/2004 Carter
6,776,179 B1 * 8/2004 Chen ..... 135/147
6,779,538 B2 8/2004 Margante et al.
6,796,320 B2 9/2004 Carter
6,874,520 B2 4/2005 Carter
6,892,744 B2 5/2005 Feldpausch et al.
6,920,889 B2 7/2005 Carter
6,926,021 B2 8/2005 Carter
6,929,017 B2 8/2005 Byun
6,981,510 B2 1/2006 Carter
6,994,099 B2 2/2006 Goldwitz
7,025,074 B2 4/2006 Porter
7,044,083 B2 5/2006 Farmer et al.
7,044,146 B2 5/2006 Losi, Jr.
7,051,745 B2 5/2006 Carter
7,063,029 B1 6/2006 Tsui et al.
D535,349 S 1/2007 Shinner et al.
7,168,372 B2 1/2007 Fotia
7,168,439 B2 1/2007 Patel et al.
7,178,539 B2 2/2007 Patel et al.
7,178,541 B2 2/2007 Carter
7,178,542 B2 2/2007 Carter
2002/0170588 A1 * 11/2002 Seo ..... 135/90
2003/0034061 A1 * 2/2003 Warner ..... 135/144

* cited by examiner

PORTABLE ADJUSTABLE SHADE STRUCTURE

FIELD OF THE INVENTION

The present invention relates generally to the field of portable canopies, specifically a lightweight, portable canopy that can be erected and collapsed by a single individual, and one that allows a tilting of the shading surface to angles relative to the ground.

BACKGROUND OF THE INVENTION

Many foldable and collapsible structures for providing shelter from the weather or elements are already commercially available. Most of these products provide a shelter with some sort of domed or pointed roof. Many of these structures are complex and cumbersome in construction.

A drawback to the commonly available portable structure is the massive size and weight of the main supporting structure, thereby making them heavy, cumbersome and generally difficult to transport, especially for a single individual. Many of the collapsible structures that are portable are not small enough to be practical for personal or small group use. Additionally, due to the weight and size, some canopies require multiple people for assembly.

A problem with conventional structures is the inability of the canopies to adapt or accommodate for different circumstances. For many of these structures, the main objective is covering from the elements like rain or wind, and as such, typically the structure has some sort of peak for providing runoff from rain or additional supports to provide stability from wind. The construction to accommodate these situations is reinforced so as to make them rigid and not easily adapted or angled to adjust for the movement of the sun in relation to the user. In order to remain protected from the sun, the user has to move under the structure or move the structure base for better placement of shade. The inability of these canopies to adapt can frustrate the end use of providing shade. In addition, the size and nature of these structures makes them less accessible for use at a beach or for small gatherings where users prefer to be relatively unencumbered by bulky or heavy materials.

As such, it would be of great utility to have a portable canopy structure, one that is lightweight and sturdy, and can be erected and taken down by a single user, and one that would be capable of being adjusted so that the canopy can be made to adapt to the movement of the sun.

SUMMARY OF THE INVENTION

The present invention is a canopy structure comprising a frame and a canopy. The frame comprises a plurality of arms and legs, where each of the arms extends outwardly from a central connecting member to a leg, each arm and leg being joined by a leg connecting member. Each leg comprises an upper section and a lower section, and each arm comprises an inner section and an outer section. Preferably, each leg is telescopic and is lockable, more preferably in at least two telescope configurations. The central connecting member preferably comprises a releasable locking mechanism.

The present invention further comprises a mechanism by which the canopy surface can be tilted to angles relative to the ground.

In one embodiment, the user can change the angle of the top of the canopy by adjusting each of the leg connecting members and further by adjusting the telescope configurations of at least one leg.

In another embodiment, the canopy further comprises a series of cross arms, whereby the cross arms are structures that begin at one leg, preferably below or just below the leg connecting member of that leg, at a cross arm connecting member and extend to an adjacent leg, ending preferably below or just below the leg connecting member of that adjacent leg at another cross arm connecting member. It is preferred that each leg is connected to each adjacent leg by at least one cross arm, such that the cross arms in aggregate essentially form a perimeter around the frame, when viewed from above. In this particular embodiment, the user can change the angle of the canopy by adjusting the telescope configuration of at least one leg.

DETAILED DESCRIPTION OF THE INVENTION

Figure 1:
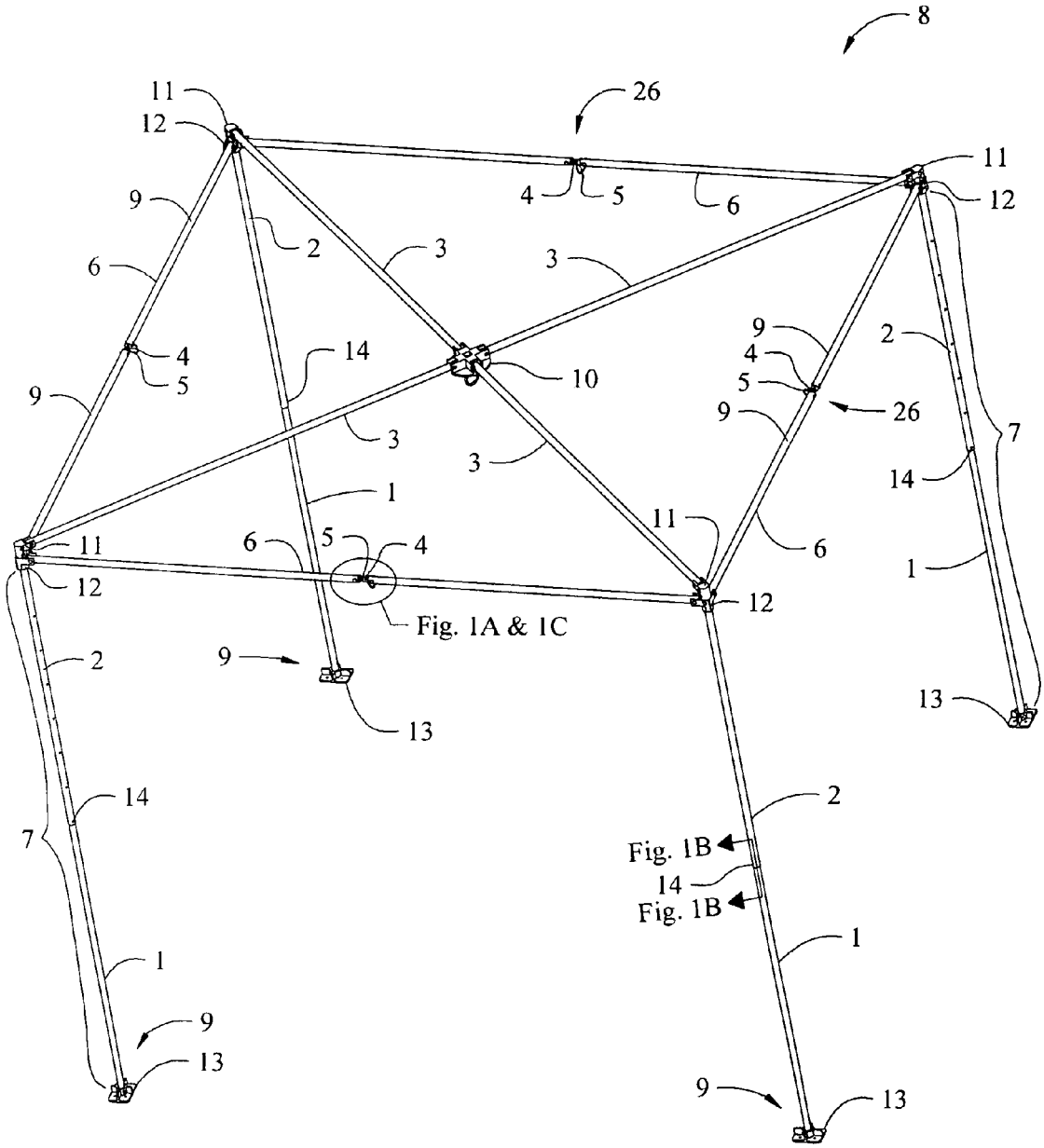
FIG. 1 is a perspective view of a fully erected embodiment of the frame of present invention.
Figure 1A:
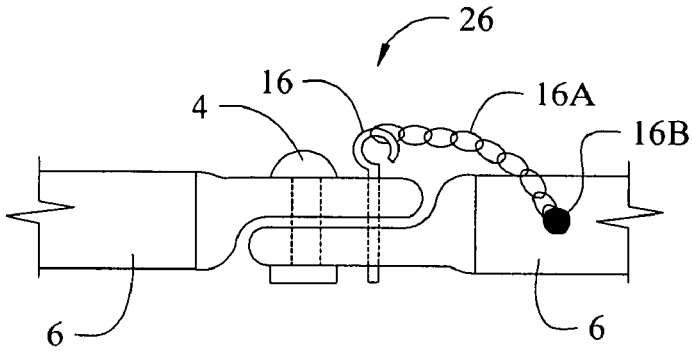
FIG. 1A is a detail view of a portion of an embodiment of a cross arm of the present invention.
Figure 1B:
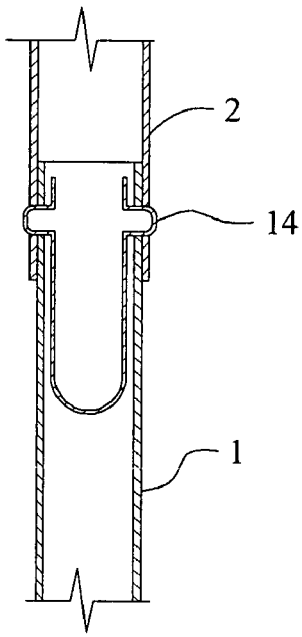
FIG. 1B is a cross section view of a portion of a leg of the present invention, detailing an embodiment of an internal telescoping mechanism.
Figure 1C:
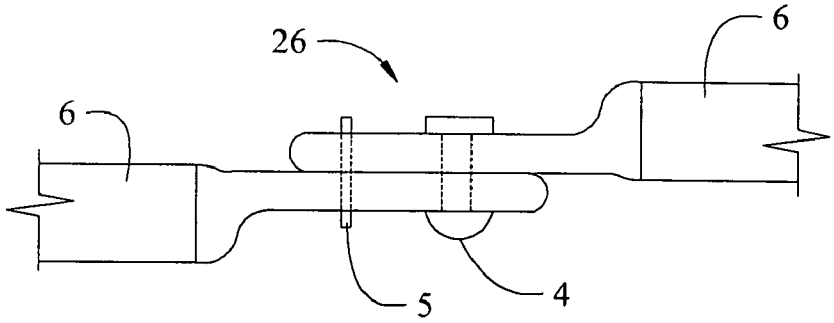
FIG. 1C is a detail view of a portion of an embodiment of a cross arm of the present invention.
Figure 1D:
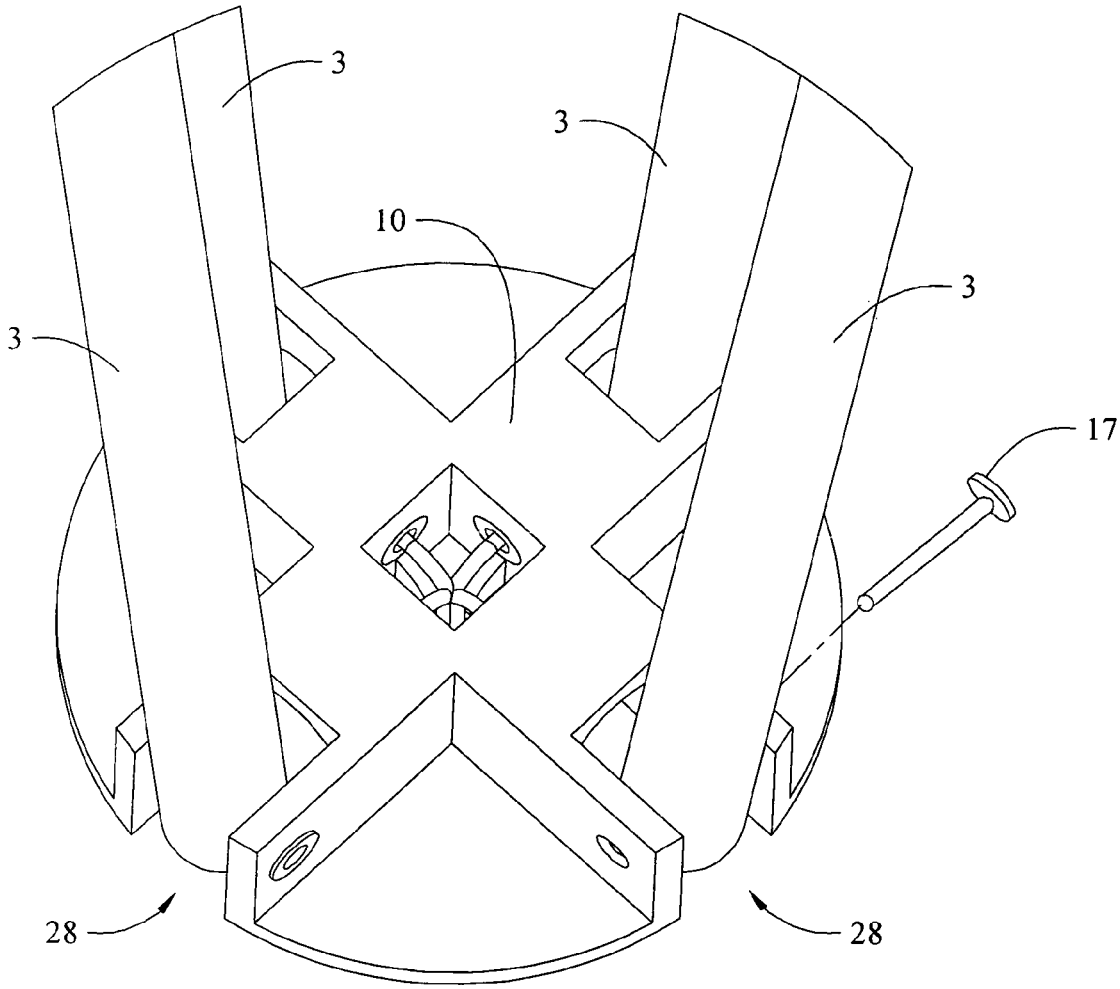
FIG. 1D is a perspective detail view of an embodiment of the central connecting member of the present invention, where the arms have been at least partially collapsed.
Figure 2:
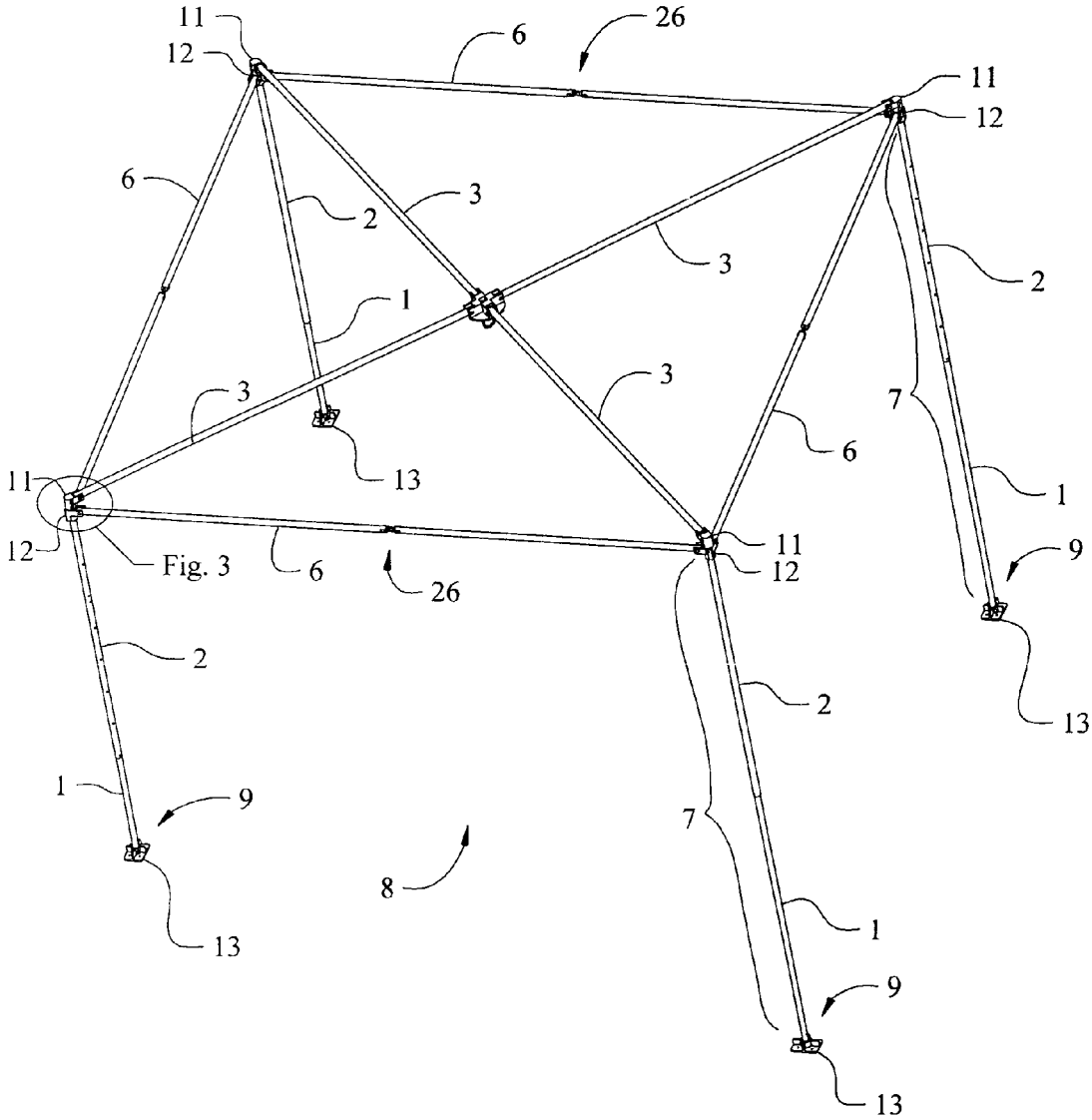
FIG. 2 is a perspective view of an embodiment of a fully erected frame of the present invention, detailing an embodiment of a tilted frame.
Figure 3:
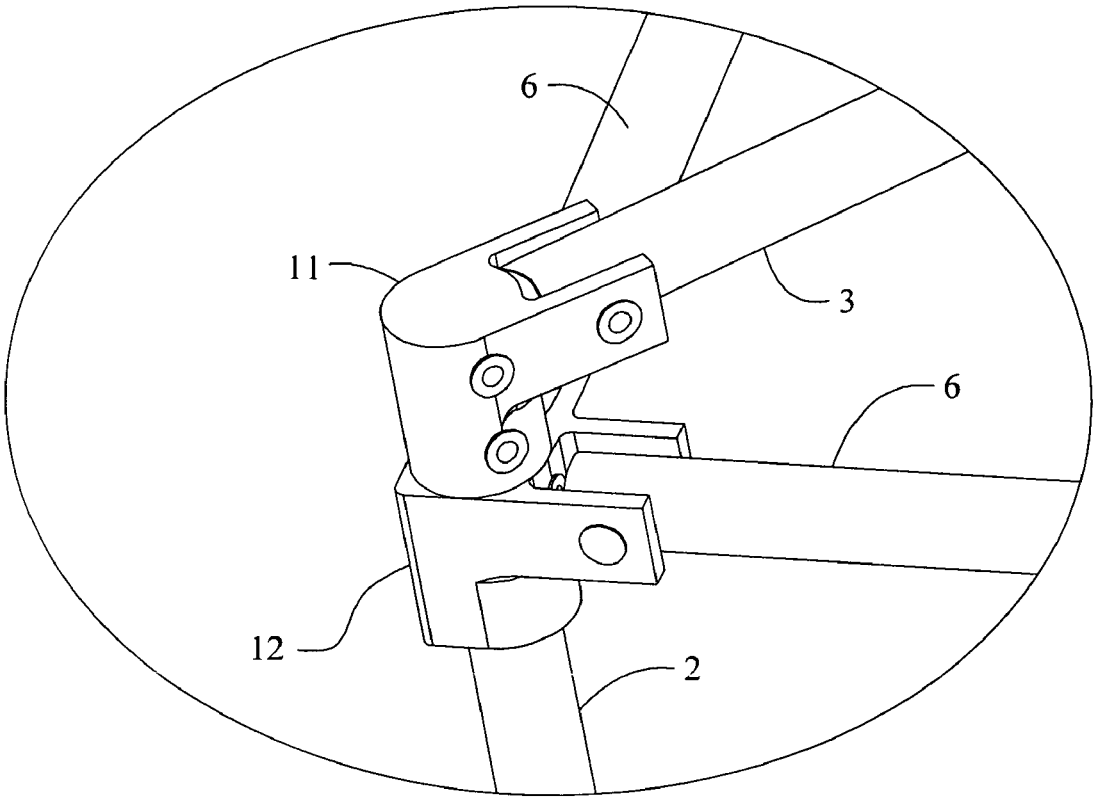
FIG. 3 is a detailed perspective view of an embodiment of a leg connecting member and an embodiment of a cross arm connecting member of the present invention.
Figure 4:
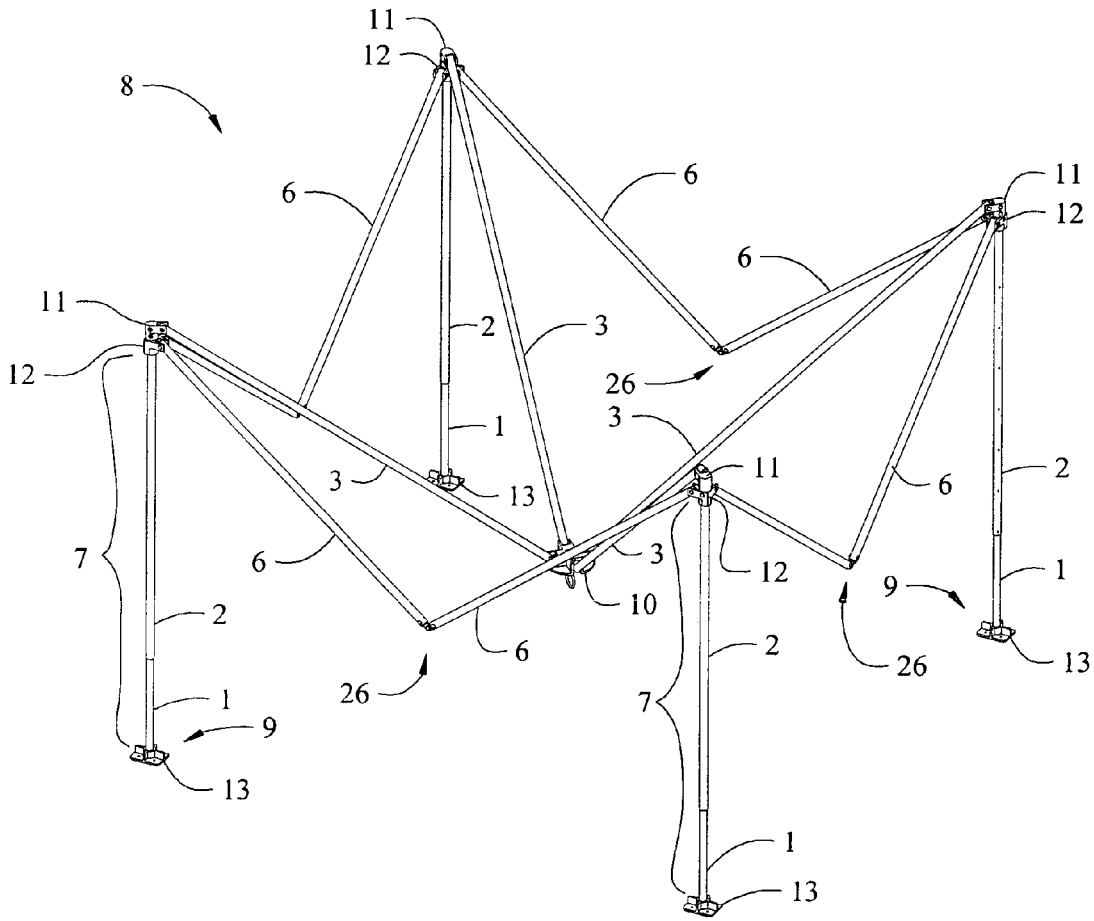
FIG. 4 is a perspective view of an embodiment of a frame of the present invention, detailing a frame that is in a transition state between being fully erected and fully collapsed.
Figure 5:
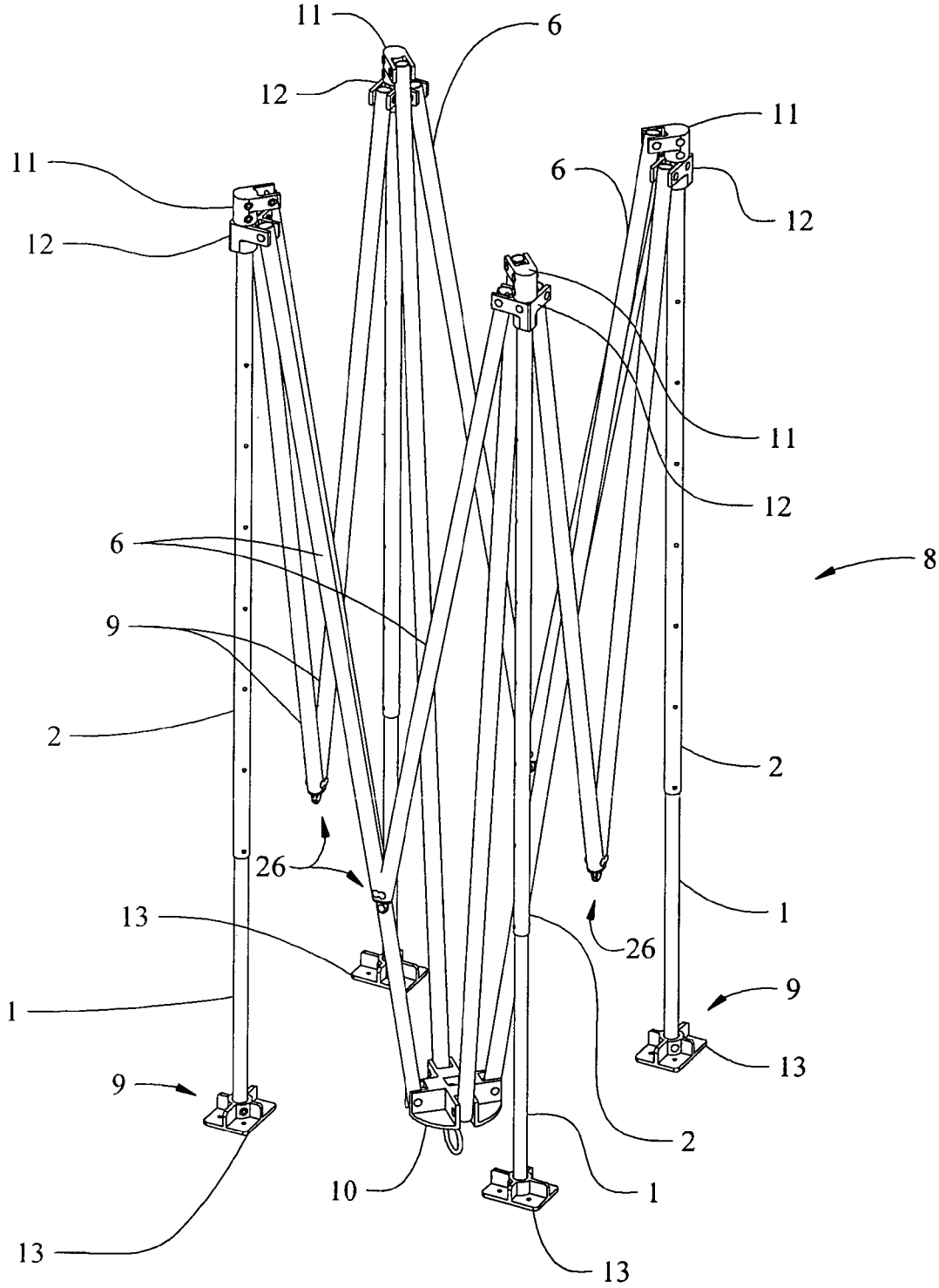
FIG. 5 is a perspective view of an embodiment of a frame of the present invention, detailing a frame that is substantially collapsed.
Figure 6:
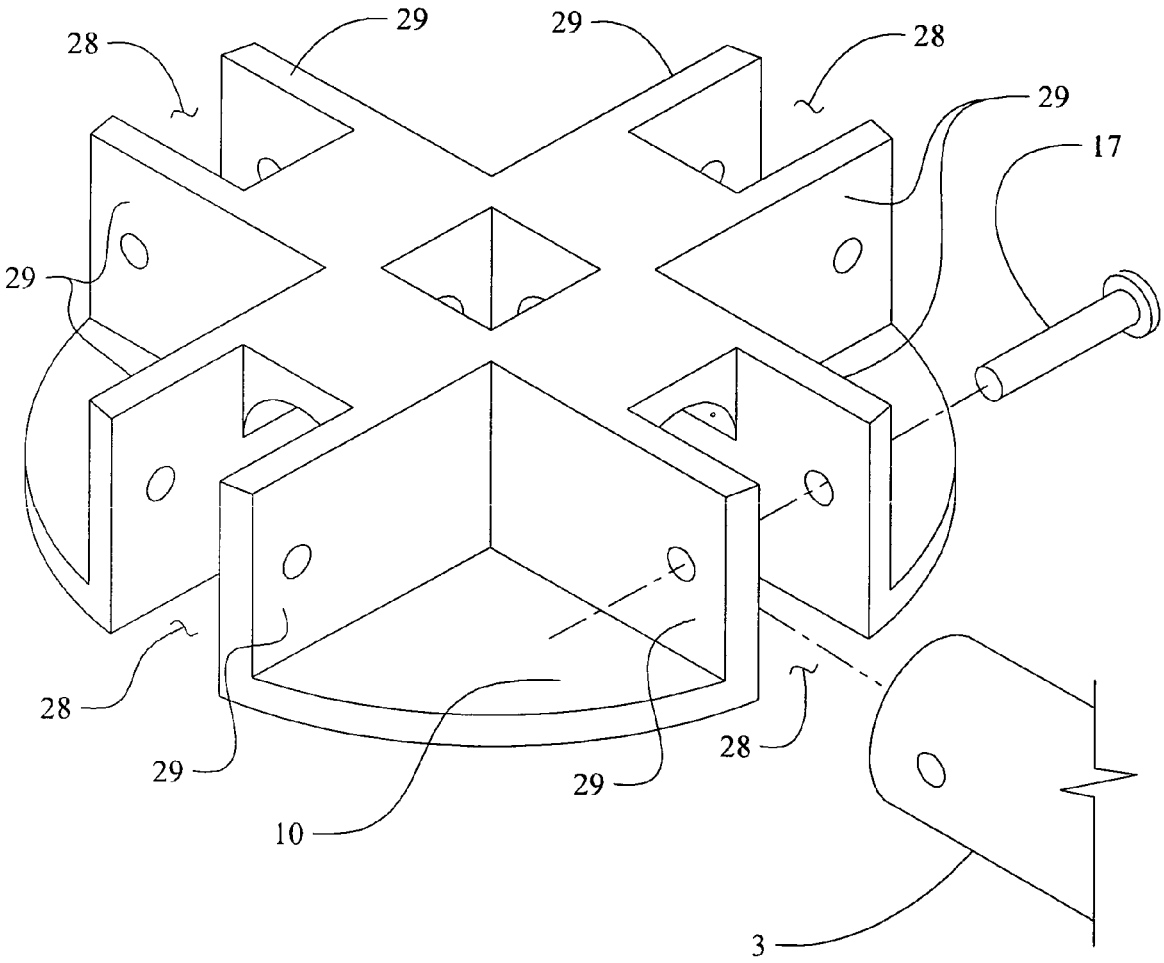
FIG. 6 is a perspective detail view of an embodiment of the central connecting member of the present invention.
Figure 6A:
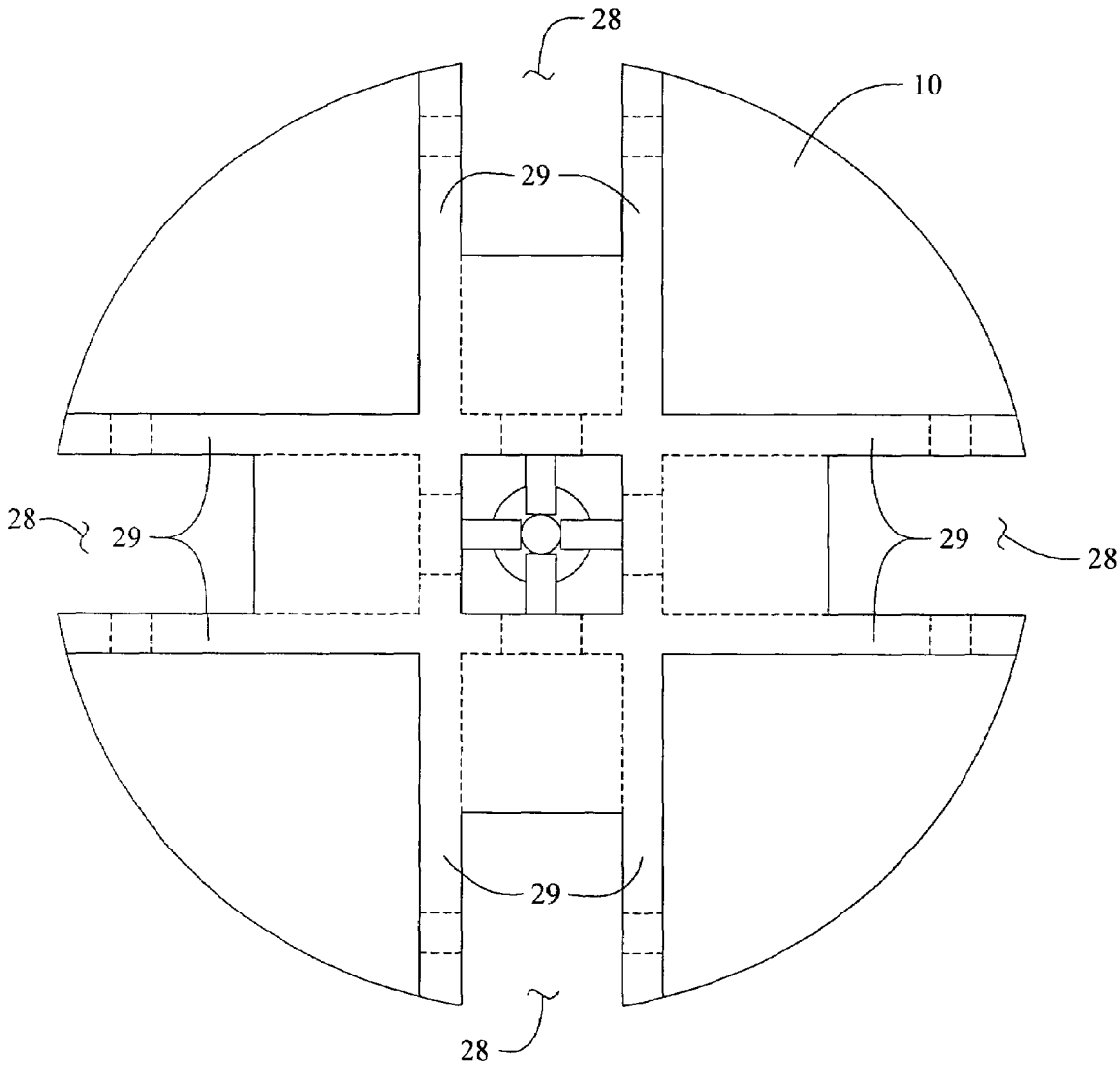
FIG. 6A is a top detail view of an embodiment of the central connecting member of the present invention.
Figure 7:
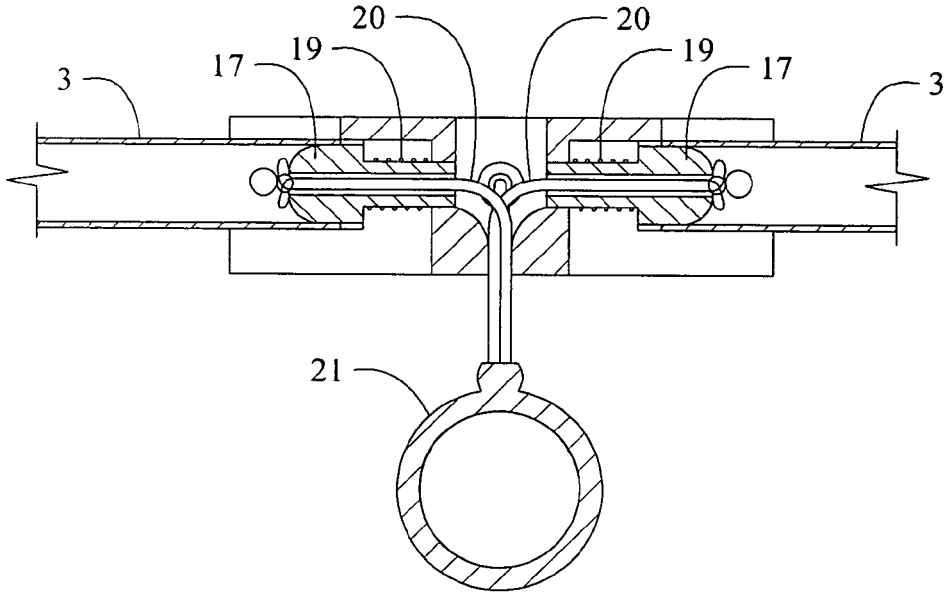
FIG. 7 is a cross section view of an embodiment of the central connecting member of the present invention, showing the arms in a locked position.
Figure 7A:
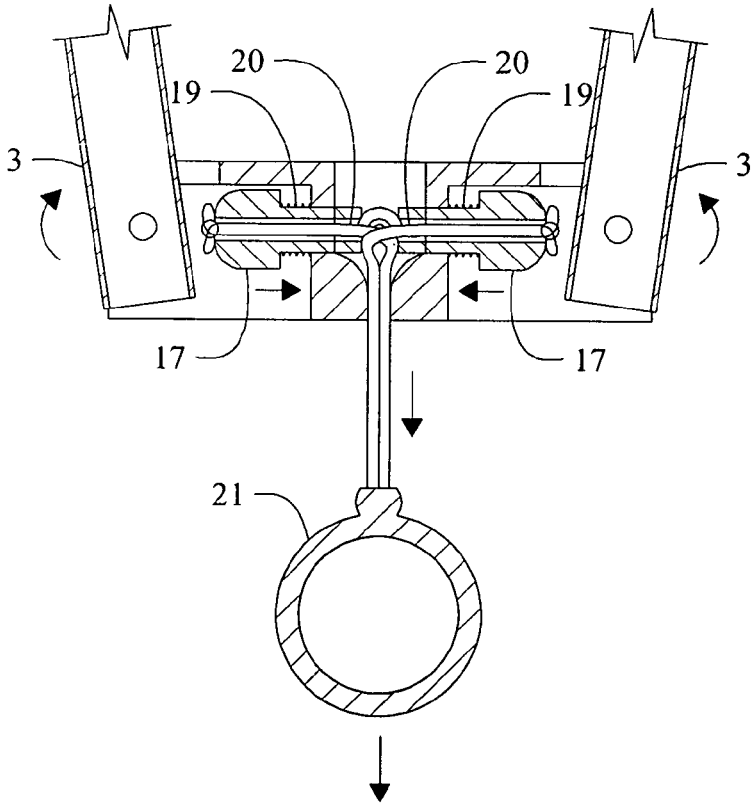
FIG. 7A is a cross section view of an embodiment of the central connecting member of the present invention, showing the arms in an unlocked position.
Figure 7B:
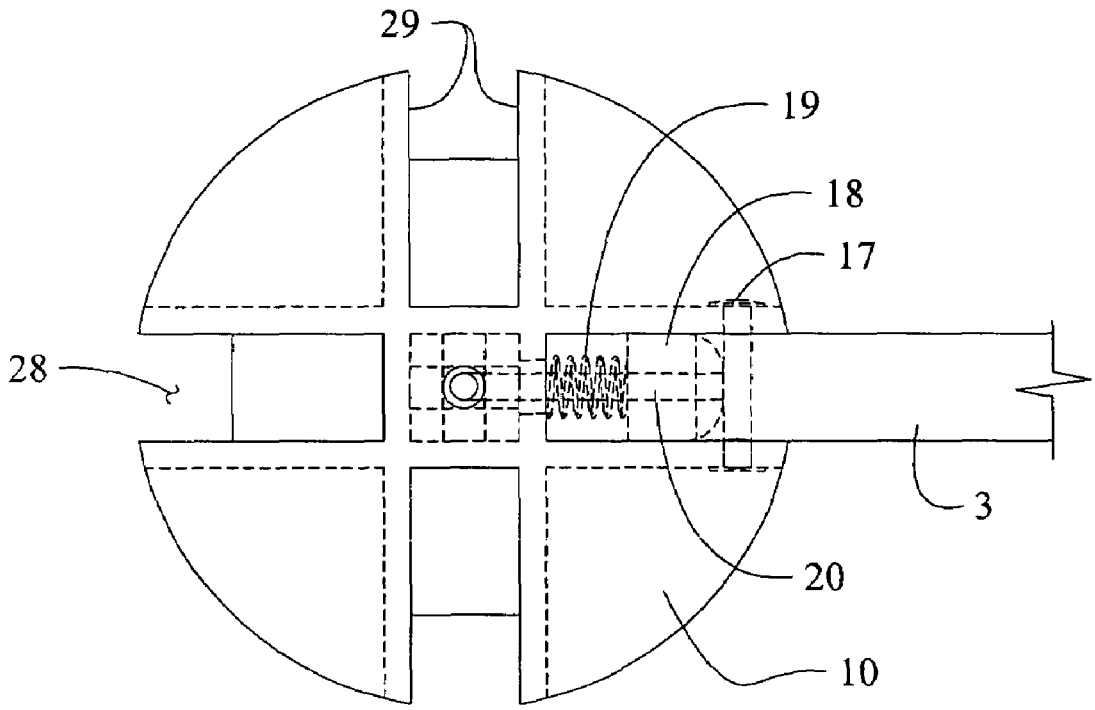
FIG. 7B is a top detail view of an embodiment of the central connecting member of the present invention, detailing an embodiment of an arm locking mechanism.
Figure 7C:
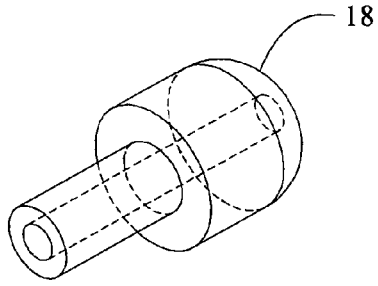
FIG. 7C is a detail view of an embodiment of a locking pin, a part of an embodiment of an arm locking mechanism of the present invention.
Figure 7D:
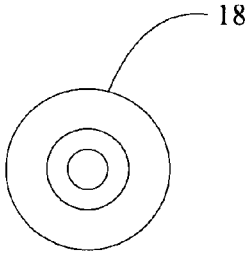
FIG. 7D is a detail end view of an embodiment of a locking pin, a part of an embodiment of an arm locking mechanism of the present invention.
Figure 7E:
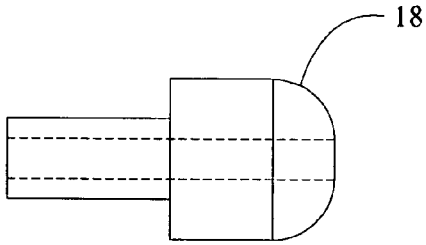
FIG. 7E is a side cross section view of an embodiment of a locking pin, a part of an embodiment of an arm locking mechanism of the present invention.
Figure 7F:
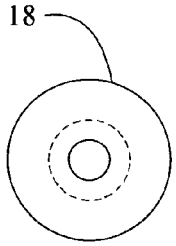
FIG. 7F is a end cross section view of an embodiment of a locking pin, a part of an embodiment of an arm locking mechanism of the present invention.
Figure 8:
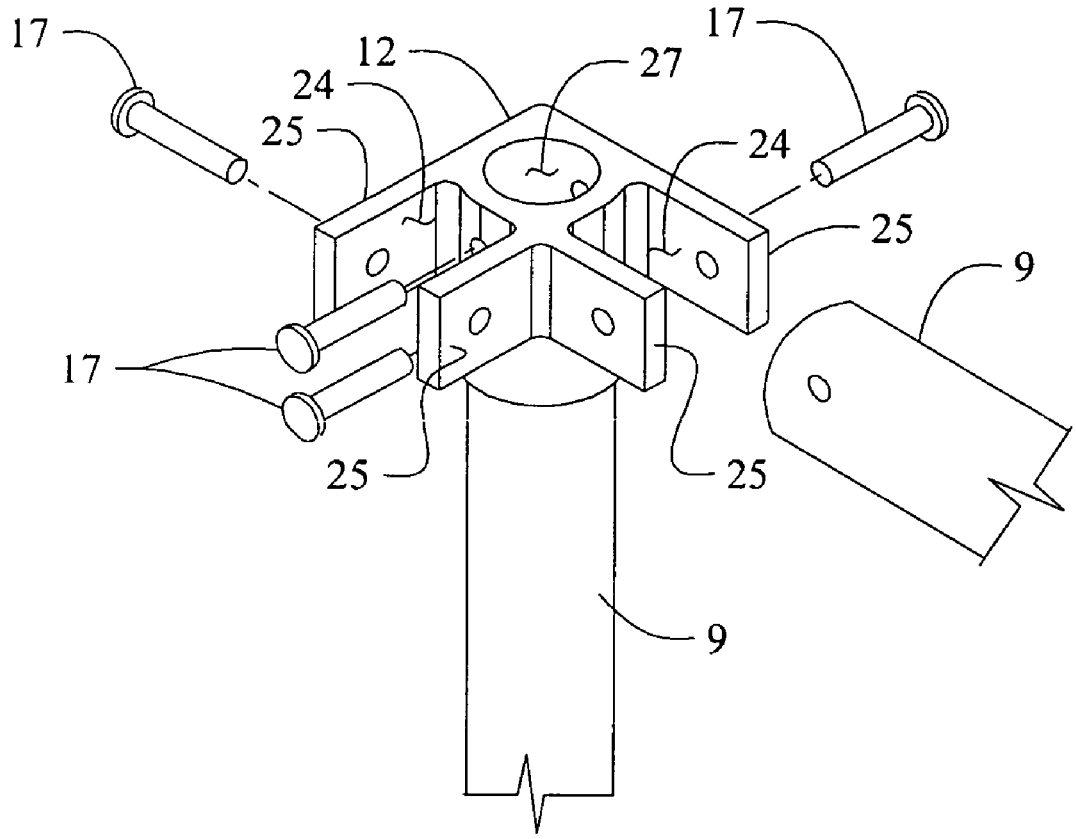
FIG. 8 is a detail perspective view of an embodiment of a cross arm connecting member of the present invention.
Figure 8A:
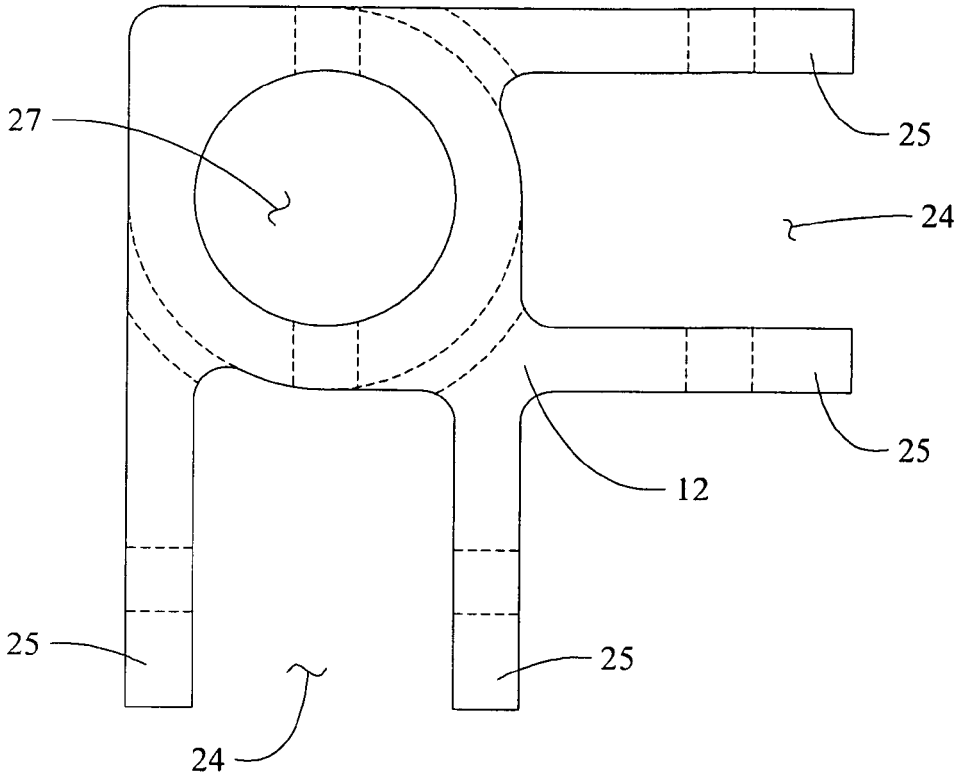
FIG. 8A is a detail top view of an embodiment of a cross arm connecting member of the present invention.
Figure 8B:
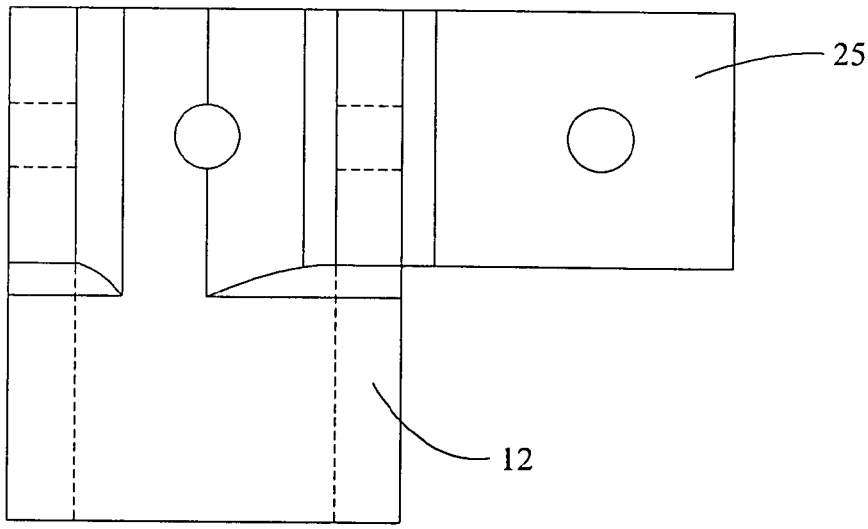
FIG. 8B is a side cross section view of an embodiment of a cross arm connecting member of the present invention.
Figure 9:
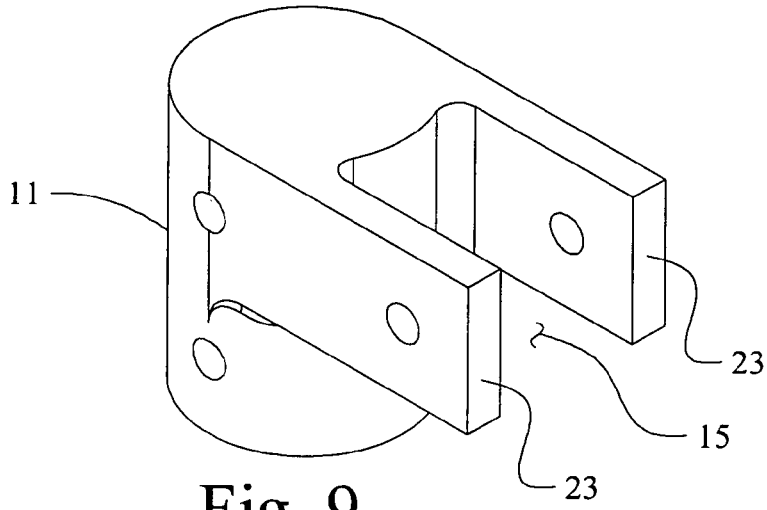
FIG. 9 is a detail perspective view of an embodiment of a leg connecting member of the present invention.
Figure 9A:
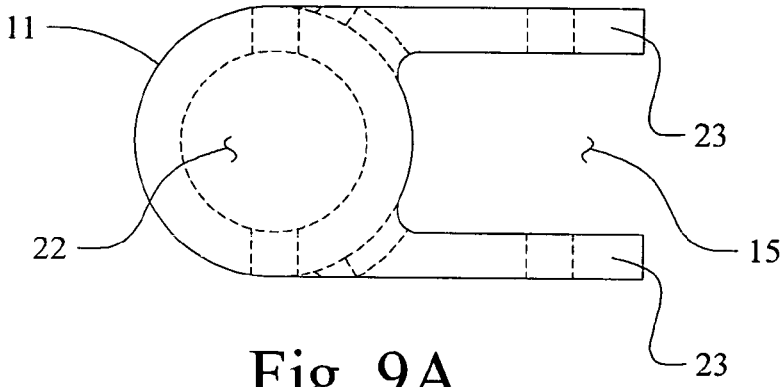
FIG. 9A is a detail top view of an embodiment of a leg connecting member of the present invention.
Figure 9B:
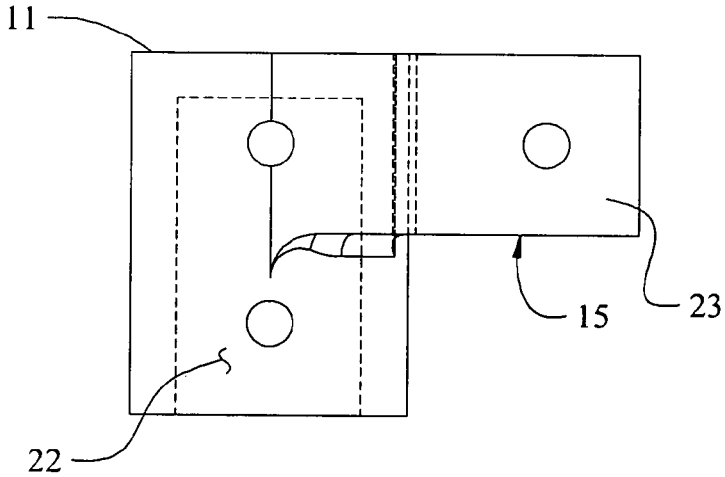
FIG. 9B is a side cross section view of an embodiment of a leg connecting member of the present invention.
Figure 10:
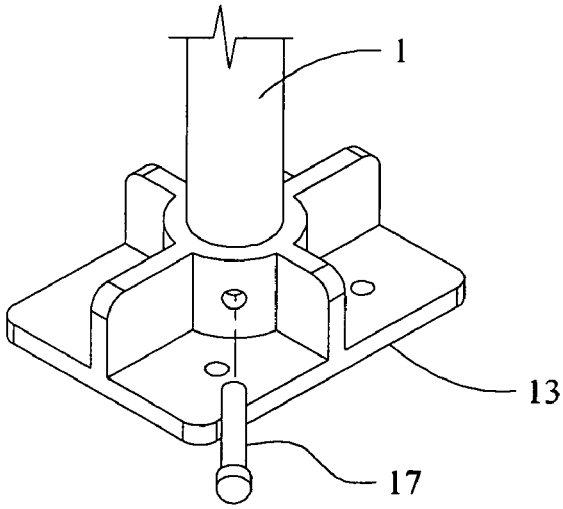
FIG. 10 is a detail perspective view of an embodiment of a foot bracket of the present invention.
Figure 10A:
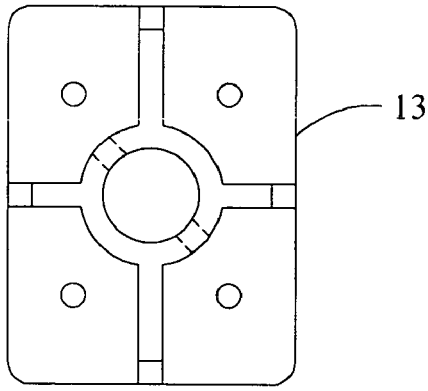
FIG. 10A is a detail top view of an embodiment of a foot bracket of the present invention.
Figure 10B:
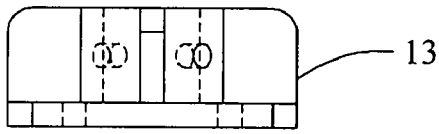
FIG. 10B is a cross section side view of an embodiment of a foot bracket of the present invention.

The present invention is a canopy structure. The canopy structure comprises a frame 8 and a canopy. Preferably the canopy structure, when viewed from above, is substantially rectangular, and more preferably the canopy is square or substantially square. In one embodiment, the canopy structure, when viewed from above, is a triangle.

The frame 8 comprises a plurality of legs 7, arms 3, leg connecting members 11 and one central connecting member 10. It is preferred that the frame 8 comprises four legs 7, four arms 3, four leg connecting members 11, and one central connecting member 10. The frame 8 may further comprise a series of cross arms 6 and cross arm connecting members 12. It is preferred that the frame 8 further comprises, when present, as many cross arms and cross arm connecting members as there are legs 7. In a particularly preferred embodiment, the frame 8 comprises four arms 3, four legs 7, four cross arms 6, four leg connecting members 11, four cross arm connecting members 12 and one central connecting member 10. In an embodiment, each leg 7 may further comprise a foot bracket 13, the foot bracket preferably secured to the leg by a rivet 17.

Each arm 3 comprises an inner section and an outer section, the inner section being oriented generally toward the center portion of the top of the frame 8. Each leg 7 comprises an upper section 2 and a lower section 1, the upper section oriented generally toward the top portion of the frame 8 and the lower section oriented generally downwardly.

The inner section of each of the arms 3 is pivotally connected to the central connecting member 10, and the outer end of each of the arms is pivotally connected at a respective leg connecting member 11. Each leg connecting member 11 further is connected to the upper section of a leg, and may be so connected either pivotally or rigidly. Each leg 7 further comprises a bottom section 9, the bottom section providing support for the canopy structure. When present, a foot bracket 13 resides at the base of the bottom section 9 of the leg 7.

In another embodiment, the frame 8 further comprises a series of cross arms 6, whereby the cross arms are structures that extend from a cross arm connecting member 12 of one leg, residing below or preferably just below the leg connecting member 11 of that leg 7, to a cross arm connecting member 12 of an adjacent leg 7, residing preferably below or just below the leg connecting member 11 of that adjacent leg 7. It is preferred that each leg 7 is connected to each adjacent leg 7 by one cross arm 6, such that the cross arms in aggregate essentially form a perimeter around the canopy structure, when viewed from above. In another embodiment, where four legs 7 are present, there may be two cross arms 6 present, where the cross arms each connect two distinct legs 7, such that the two cross arms 6 are substantially parallel when the canopy structure is substantially erected. Preferably each cross arm 6 is substantially parallel to the plane created by the arms 3 of the canopy structure when the canopy structure is fully erected.

Each leg connecting member 11 further comprises an arm bracket 15 and a leg bracket 22. In one embodiment, it is preferred that the leg 7 and the leg connecting member 11 remain rigid with respect to one another, such rigidity preferably achieved by inserting the end of the upper section 2 of a leg into the leg bracket 22 of the leg connecting member 11, and the insertion of at least one rivet 17 or the like, preferably two rivets 17, where the leg bracket 22 is an orifice or opening of such complimentary shape that the end of the upper section 2 of the leg may be inserted therein. In one embodiment, it is preferred that the arm 3 and the arm bracket 15 are pivotally connected to one another, whereby the arm may rotate around an axis within the arm bracket 15, the axis preferably being achieved through a rivet 17, the rivet connecting the arm 3 and two arm bracket wall surfaces 23, the arm bracket wall surfaces residing on opposing sides of the end of the outer section of the arm 3.

When present, each cross arm connecting member 12 further comprises a leg orifice 27 and two cross arm brackets 24. The leg orifice 27 is an opening through which the upper section 2 of the leg resides. Each cross arm bracket 24 preferably is pivotally connected to a cross arm 6, whereby the cross arm may rotate around an axis within the cross arm bracket, the axis preferably being achieved through a rivet 17, the rivet connecting the cross arm 6 and two cross arm bracket wall surfaces 25, the cross arm bracket wall surfaces residing on opposing sides of the end of the of the cross arm 6.

When present, each cross arm 6 further comprises a cross arm joint 26, where the cross arm joint is a mechanism by which the cross arm pivotally folds during the collapsing of the frame 8, the pivotable folding preferably occurring at or near the center of each cross arm. When the canopy structure is erected, the cross arm joint 26 may be secured in a sturdy unfolded position, such that the cross arm 6 is substantially linear, in any manner known to those of ordinary skill in the art, such as through the use of a removable insertable pin 16 or through the use of a slip ring 5 or washer. Where an insertable pin 16 is used, it may be desirable to have the pin secured to the cross arm 6 by a chain 16A at a chain link point 16B. The cross arm 6 may fold at the cross arm joint 26 around a cross arm rivet 4, or any other device known to those of ordinary skill in the art.

Preferably, the central connecting member 10 comprises a releasable canopy locking mechanism and a plurality of central arm brackets 28. In one embodiment, the releasable canopy locking mechanism comprises a ring 21, a cable 20, a spring 19 and a locking pin 18, where the ring resides outside of and below the central connecting member 10 and is connected to a cable, the cable being connected to a plurality of locking pins, where there is one locking pin 18 for each arm 3 present in the frame 8, the locking pins residing substantially within the central connecting member 10. In this embodiment, each locking pin 18 is pushed by a respective spring 19 away from the center of the central connecting member 10 and into a hollow opening at the end of the inner section of the arm 3, so as to provide stable support for each arm 3 relative to the central connecting member 10. In operation, to at least partially collapse an erected canopy structure, the user may pull down on the ring 21, whereby the cable 20 pulls each locking pin 18 toward the center of the central connecting member 10, thereby depressing each respective spring 19, this movement of the locking pins 18 being sufficient to withdraw them each from hollow openings at the ends of the inner sections of the respective arms 3, thereby permitting pivoting of each of the arms 3 about a respective axis within the central connecting member 10, the pivoting permitting the folding of each of the arms 3 into substantially parallel positions, where the axis is preferably achieved through the use of a rivet 17, the rivet connecting the arm 3 and two respective central arm bracket wall surfaces 29, the central arm bracket wall surfaces residing on opposing sides of the end of the inner section of the arm. It is preferred that the central arm brackets 28 be arcically equidistant from one another, such that when the canopy structure is fully erected, the angles between each arm 3 and each adjacent arm 3 are substantially equal throughout the canopy structure.

In an embodiment, the user may change the angle of the top of the canopy structure by adjusting the telescope configurations of at least one leg 7. In operation, where the canopy structure is a rectangle when viewed from above, the user would determine the desired approximate angle relative to the ground that the top of the canopy structure should be adjusted to, and further the user would determine the desired direction in which the slope of the top of the canopy structure should be oriented. Upon making these determinations, the user may proceed to the side of the canopy structure that he desires to lower, and he would adjust the two adjacent legs 7 that define that side of the canopy structure to substantially identical telescopic configurations, the telescopic configurations determining the angle relative to the ground that the top of the canopy structure is being adjusted to. If the user desires a steep slope of the top of the canopy structure, he may choose to telescope the legs 7 in such a manner as to reduce the overall height of the legs by a more severe measurement than if a lesser steeped slope was desired.

Preferably, the user can operate the leg connecting members 11, the central connecting member 10 and the cross arm joints 26 in concert, to enable the canopy to be erected for use or collapsed so as to be stored or carried. Even more preferably, the user can operate the central connecting member 10 to enable the canopy to be erected for use or collapsed so as to be stored or carried.

The canopy is preferably securely attached to the top of the frame 8, though the canopy can be removed for cleaning, repair, replacement or the like. In an embodiment, the canopy consists essentially of a flexible material capable of transitioning between a collapsed and erected state. It is preferred that the canopy be substantially waterproof. It is preferred that the canopy provide substantial protection from ultraviolet sunlight.

In an embodiment, two adjacent legs 7 are identical fixed lengths and the other two legs are telescopic legs. In an embodiment, the telescopic legs each further comprise an internal telescoping mechanism 14. In an embodiment, all of the legs 7 are telescopic legs. It is preferred that, where a leg 7 is telescopic, the lower section 1 of the leg telescopes into the upper section 2 of the leg, and the secure position of the upper and lower sections of the leg relative to one another is achieved through an internal telescoping mechanism 14, such as an internal U-spring, or other mechanisms know by those of ordinary skill in the art.

In another embodiment of the present invention, no cross arms 6 or cross arm connecting members 12 are present. It is preferred in this embodiment that the canopy structure be of a rectangular shape, and more preferably of a square shape, when viewed from above. In this embodiment, it is preferred that each of the leg connecting members 11 comprises a releasable locking mechanism that provides stable support between the leg 7 and the leg connecting member. The aforementioned releasable locking mechanism may be adjustably altered so as to change the angle between the leg and the top surface of the canopy. Such a releasable locking mechanism may be of any type known to those of ordinary skill in the art. A user may, in this embodiment, where four legs 7 are present, change the angle of the canopy by adjusting each of the four leg connecting members 11 at the respective adjustable locking mechanisms and further by adjusting the telescope configurations of two adjacent legs 7.

In another embodiment of the present invention, where no cross arms 6 or cross arm connecting members 12 are present, the canopy structure is a triangular shape, when viewed from above. In this embodiment, it is preferred that each of the leg connecting members 11 comprises a releasable locking mechanism that provides rigid support between the leg and the leg connecting member. The aforementioned releasable locking mechanism may be adjustably altered so as to change the angle between the leg 7 and the top surface of the canopy. Such a releasable locking mechanism may be of any type known to those of ordinary skill in the art. A user may, in this embodiment, where three legs 7 are present, change the angle of the canopy by adjusting each of the three leg connecting members 11 at the respective adjustable locking mechanisms and further by adjusting the telescope configurations of either two adjacent legs 7 or one leg.

In an embodiment of the present invention, the central connecting member 10 further comprises a raised protrusion on the top surface of the central connecting member, whereby the raised protrusion results in a top canopy surface that is not planar.

The arms 3 and legs 7, and the cross arms 6, when present, are all preferably made of substantially the same material, that material preferably being a lightweight, sturdy material that can withstand substantial outdoor use and exposure to the elements.

In a particularly preferred embodiment of the present invention, the canopy structure comprises a frame 8 and a canopy, wherein the frame comprises a central connecting member 10 and at least three legs 7, at least three arms 3, and at least three leg connecting members 11, where there is an equal amount of arms, legs and leg connecting members; and wherein each leg 7 comprises a upper section 2 and a lower section 1, each arm 3 comprises an inner section and an outer section; and wherein the outer section of each arm is connected to the upper section 2 of a leg at a leg connecting member, and the inner section of each arm is pivotally connected to the central connecting member; and wherein at least one leg is telescopic; and wherein the central connecting member comprises a releasable locking mechanism; and wherein the canopy structure has a top, the top being at least partially defined by the plane created by the arms when the canopy structure is in an expanded state, and wherein the top may be adjusted to an angle relative to the ground through the adjusting of the at least one telescopic leg to a length that varies from the length of the other legs 7. It is preferred that the frame 8 comprises one central connecting member 10, four legs 7, four arms 3, and four leg connecting members 11. It is preferred that at least two legs are telescopic, and more preferred that each leg 7 is telescopic.

It should be understood that the aforementioned embodiments are for exemplary purposes only and are merely illustrative of the many possible specific embodiments that can represent applications of the principles of the invention. For the purposes of example only, it should now be understood that the canopy can be three-sided, i.e. triangular, or circular or any other desired shape suitable for use with the canopy structure of the present invention. Furthermore, it should now be understood by one or ordinary skill in the art how to adapt the canopy structure, if needed, to a selected canopy shape using the present invention.

Without departing from the spirit and scope of this invention, one of ordinary skill in the art can make various changes and modifications to the invention to adapt it to various usages and conditions, including those not specifically laid out herein. As such, those changes and modifications are properly, equitably, and intended to be, within the full range and scope of equivalents of the invention disclosed and described herein.

I claim:

1. A canopy structure comprising a frame and a canopy, wherein the frame comprises a central connecting member and four legs, four arms, and four leg connecting members; and wherein each leg comprises an upper section and a lower section, each arm comprises an inner section and an outer section; and wherein the outer section of each arm is connected to the upper section of a leg at a leg connecting member, and the inner section of each arm is pivotally connected to the central connecting member; and wherein each leg is telescopic; and wherein the canopy structure has a top, the top being at least partially defined by a plane created by the arms when the canopy structure is in an expanded state, and wherein the top may be adjusted to an angle other than horizontal through the adjusting of two adjacent telescopic legs to a length that varies from the length of the other two legs; and wherein each leg connecting member comprises an arm bracket and a leg bracket, where the outer section of each arm is connected to the upper section of a leg at the arm bracket, and where the upper section of each leg is connected to the leg bracket; and wherein each leg and respective leg connecting member remain rigid with respect to one another, where the rigidity between each leg and respective leg connecting member is achieved by inserting the end of the upper section of a leg into the leg bracket of the leg connecting member, and the insertion of at least one rivet, where the leg bracket is an orifice or opening of such complementary shape that the end of the upper section leg may be inserted therein; and wherein each arm and respective arm bracket are pivotally connected to one another, where the pivotal connection between each arm and respective arm bracket is defined by the rotation of each arm around an axis within each respective arm bracket, the axis being achieved through a rivet, the rivet connecting the arm and two arm bracket wall surfaces, the arm bracket wall surfaces residing on opposing sides of the end of the outer section of the arm; and wherein the central connecting member comprises a releasable canopy locking mechanism and a plurality of central arm brackets, where the number of central arm brackets is equal to the number of arms, and wherein the inner portion of each arm and a respective central arm bracket are pivotally connected to one another, where the pivotal connection between each arm and respective central arm bracket is defined by the pivoting of each of the arms about a respective axis within each respective central connecting member, the pivoting permitting the folding of each of the arms of the frame into substantially parallel positions, where the axis is achieved through the a rivet, the rivet connecting the arm and two respective central arm bracket wall surfaces, the central arm bracket wall surfaces residing on opposing sides of the end of the inner section of the arm; and where the frame further comprises four cross arms and four cross arm connecting members, where each cross arm connecting member comprises two cross arm brackets, where the cross arms are structures that extend from one of the cross arm brackets of the cross arm connecting member of one leg, residing below or just below the leg connecting member of that leg, to a cross arm connecting member of an adjacent leg, residing below or just below the leg connecting member of that adjacent leg, and wherein each leg is connected to each adjacent leg by one cross arm, such that the cross arms in aggregate essentially form a perimeter around the canopy structure, when viewed from above, and where each cross arm is substantially parallel to the plane created by the arms of the canopy structure when the canopy structure is fully erected; and wherein the releasable locking mechanism on the central connecting member comprises a ring, a cable, a spring and a locking pin, where the ring resides outside of and below the central connecting member and is connected to a cable, the cable being connected to four locking pins, the locking pins residing substantially within the central connecting member, and where each locking pin is pushed by a respective spring away from the center of the central connecting member and into a hollow opening at the end of the inner section of the arm, so as to provide substantially stable support for each arm relative to the central connecting member.

* * * * *